United States Patent [19]

Lombardo

[11] Patent Number: 4,819,270

[45] Date of Patent: Apr. 4, 1989

[54] STEREO DIMENSIONAL RECORDING METHOD AND MICROPHONE APPARATUS

[76] Inventor: Leonard Lombardo, 18695 Hwy. 9, Boulder Creek, Calif. 95006

[21] Appl. No.: 881,632

[22] Filed: Jul. 3, 1986

[51] Int. Cl.[4] ..... H04R 5/027

[52] U.S. Cl. ..... 381/26; 381/169

[58] Field of Search ..... 381/68, 69, 26, 68.5, 381/169, 170, 187, 188

[56] References Cited

U.S. PATENT DOCUMENTS

| | | | |
|---|---|---|---|
| 2,930,857 | 3/1960 | Hollingsworth | 381/68 |
| 3,035,127 | 5/1962 | Strzalkowski | 381/68.5 |
| 3,227,836 | 1/1966 | Renwick, Sr. | 381/68 |
| 3,306,991 | 2/1967 | Wood | 381/72 |
| 3,422,224 | 1/1969 | Curran | 381/187 |
| 3,588,384 | 6/1971 | Negley | 381/68.5 |
| 3,770,911 | 11/1973 | Knowles et al. | 381/68.5 |
| 3,836,732 | 9/1974 | Johanson et al. | 381/68.5 |
| 4,010,335 | 3/1977 | Yasuda | 381/26 |
| 4,037,064 | 7/1977 | Yasuda | 381/26 |
| 4,088,849 | 5/1978 | Usami et al. | 381/26 |
| 4,119,798 | 10/1978 | Iwahara | 381/26 |
| 4,388,494 | 6/1983 | Schöne et al. | 381/26 |

*Primary Examiner*—Forester W. Isen

*Attorney, Agent, or Firm*—Allston L. Jones

[57] ABSTRACT

A stereo dimensional recording method and microphone apparatus which produces a quality stereo signal output, that, when combined with any stereo audio recorder, allows the recording professional and amateur enthusiast excellent stereo sound with depth dimension realism independent of sound stage distances when reproduced by both headphones and loudspeakers without the need for additional frequency or phase processing equipment/circuits. The apparatus is virtually visually unobtrusive when personally worn on the user's head by means of a variety of mounting accessories, is unfatigueing when in use, does not impair the hearing of the wearer, and does not interfere with live listening enjoyment during recording.

11 Claims, 2 Drawing Sheets

STEREO DIMENSIONAL RECORDING METHOD AND MICROPHONE APPARATUS

BACKGROUND OF THE INVENTION

1. Field of the Invention

This invention relates to stereo sound recording methods with sound pickup systems, i.e., positioned microphones, that find use in live personal and professional recording activities when coupled to any professional recorder or any of the numerous recording stereo deck/portable cassette tape players or sound recording equipment in consumer usage.

2. Description of Prior Art

It is well known that the natural acceptance of stereo sound playback/recording technology for consumer products, i.e., records, tapes, movies, etc. and consumer recording use has brought a multiplicity of recording microphones that permit the professional recording engineer as well as the amateur recording enthusiasts to capture live stereo sound. Moreover, the physical/mental way that we process the sound we hear has brought many different approaches to the design of said pickups/systems.

Since stereo involves information on two separate channels, more than one microphone is always used. Stereo, in its simplest form, consists of only left and right appearing sound direction, with the sound in between a mix of left and right amplitude signals. Hence, a perfect center-appearing sound can be fabricated by only mixing a left and right channel in equal amplitudes. This is precisely the technique used to produce many stereo sound recordings from monophonic sources (one microphone).

Stereo sound can also contain more complete signal information, as in the case of live field recordings, in the phase or timing arrival of sound at the pickups. This said signal information, combined with the amplitude information aforementioned, gives a more convincing illusion of the sound's left/right position and depth (as opposed to two-dimensional flat source reproduction) when played back on headphones and loudspeakers. In addition to the amplitude and timing components of stereo sound, it has been well known that additional sonic positional information is contained in the frequency response contour effect that the ears (external projecting ear features) and the inner ear canal features produce. These last features complete the realism of up/down/front/back/near/far when recorded.

Prior art has evolved to accommodate the complete stereo information gathering in this order: two microphones feed into two discrete channels of a recorder and, when said microphones are separated by a simple flat barrier, provide separate left and right information signals, but the results are without depth realism. The additional aspect of sound source depth is established by moving the microphones a specific minimum/maximum distance apart while maintaining the left/right barrier (approximately 7"–10"). The depth of the recording is further enhanced by replacing the two-dimensional barrier with a smooth three-dimensional projection in the general proportions of the human head or similar object. The two microphones are then positioned in the ear area of the improved three-dimensional barrier.

Prior art furthered the refinement of technique and equipment by not only simulating the general shape of the head but also by simulating the ear flaps and inner canal as well, positioning the microphones inside the dummy head.

The prior art then had to take a step back, for it was found that the signal now recorded in the dummy head-/ear/canal passage was only convincing during headphone reproduction (not loudspeakers), with the best results from the person from which the dummy head-/ears was directly modeled.

To overcome this "custom-tailored-for-only-one-person" recording limitation, the microphone position was moved to the entrance of the ear canal, referenced by Griese, et al in U.S. Pat. No. 3,969,583, at 10 mm distance from the opening. This provided recordings with better realism to more listeners removed from the subject model but only during headphone reproduction.

The merits associated with this aforementioned technique is called Binaural (two-ear) recording, which is not to be confused with the intentional proper playback environment, namely, headphones. These merits were offset by some drawbacks, however.

The prior art shows numerous dummy head type pickups as by Doi in U.S. Pat. No. 4,068,091 and personally-worn microphone devices for binaural recording, including those as in U.S. Pat. No. 3,969,583 hooked into the ear canal, those designed by Yasuda as in U.S. Pat. No. 4,010,335 inserted as a plug into the ear opening, and those also designed by Yasuda, as in U.S. Pat. No. 4,037,064 enclosed "earmuff" style windscreen assemblies. Those users who used these personally-worn devices as mentioned found them uncomfortable and often painful, as in the case of ear-inserted designs. Those amateur recording enthusiasts who endured the physical discomfort during live events also caused the unavoidable mental discomfort to those around the recordist—those who might only want to enjoy the simple activity of listening at a concert in a restful reposed position did not wish to be distracted by an obvious intrusion of microphones, especially in or on someone's ears as in the Usami, et al design as in U.S. Pat. No. 4,088,849 and such. This intrusion also limited candid recording especially with dummy head size pickups as with U.S. Pat. No. 4,068,091. Lastly, all of the prior art of the personally-worn binaural recording devices have one problem that is immediately obvious—namely, the impaired hearing of the wearer! Everything in, around the close vicinity/proximity of or covering the ears of a person changes the sound heard or distorts the signal arriving at the eardrums.

Therefore, those aforementioned recording users, when willing to endure the discomforts, must also compromise the high quality live listening experience for some future time at which said person must, solely or with few others, don headphones to hear the sonic recreation of the performance.

Thus, prior art has left this pursuit to the few die-hard recording buffs with numerous headphone sets/output equipment so that they don't completely die of loneliness with unshareable recordings.

Past attempts to frequency/phase adjust the output of such devices so that loudspeaker output/reproduction could recreate the real depth and tonal balance of the live sound as in U.S. Pat. No. 4,010,335 have largely failed to overcome the headphones-only limitation.

There is little wonder that the original recording enthusiasm generated by this said technique in the seventies has all but disappeared, only to be occasionally used for movie sound tracts, with the resulting effect of very few binaural recording pickups being manufactured and presently sold. This is ironic since the number of professional and consumer portable recorders has grown, making portable live recording more practical than ever before.

The handheld versions of stereo sound capturing pickups, while physically unimpairing while being held in clamping mounts or stands, remain obtrusive to the casual onlooker. They also produce largely unnaturally distorted and two-dimensional sounding recordings on headphones and loudspeakers alike. These microphones contain two or more pickup elements arranged such that two of the elements face directly left and right; the elements are usually of unidirectional design, though they can be of omni-directional design. These same handheld versions place the said pickup elements very close together within a common case, so that there is no way they can record the necessary acoustic delay associated with normal left and right hearing as done by the ears of a person. The recordings, accordingly, have a decided flat and two-dimensional character since none of these necessary depth perception sonic delayed signals are recorded.

In addition, these same microphones often use pickups of unidirectional design which cause a distortion and cancellation of off-axis sound sources. While these microphones give acceptable performance when very close to the intended sound source, placement of these microphones at a moderate distance from the sound stage magnifies the distortion to unacceptable levels. This distortion is further increased by clever one-piece stereo microphones which have three pickup elements. The third element is concerned with the reception of the center channel of the sound stage so that the output of said pickup can be subtracted from the left and right pickup outputs to enhance the stereo separation effect of the microphone. While this does increase the apparent separation response of these small assemblies, the resulting phase distortion from all of this synthesizing produces outputs ranging from inferior to awful.

Needless to say, user satisfaction and acceptance of these products is very low. Prospective buyers of microphone equipment for stereo recording who have done their homework in reviewing available equipment usually opt for two separate and quite obvious to view microphones to provide them with at least a low distortion recording. These said buyers then separate the individual microphones by some distance, usually one to eight feet, to capture some fraction of the live performance depth and field. This approach, again, is only for the professional and die-hard amateurs and not for the public in general with a more casual interest in live recording.

SUMMARY OF THE INVENTION

It is an object of the present invention to provide a novel and superior stereo pickup apparatus free from the prior art drawbacks. Another object of this invention is to implement a new approach to sound recording technique that is neither Binaural or stereo but a hybrid of the two.

This new technique is to be referred to as STEREO DIMENSIONAL RECORDING and the apparatus of the present invention is to be referred to as STEREO DIMENSIONAL MICROPHONE APPARATUS, which is personally-wearable or dummy-head mounted.

Another object of this invention is to provide a personally-wearable microphone apparatus that in no way interferes with the delicate hearing mechanisms of the wearer of said microphone apparatus.

Another object of this invention is to provide an unobtrusive personally-wearable microphone apparatus that is small in physical size.

Another object of this invention is to provide the wearer of the apparatus aforementioned with absolute comfort and ease of using the apparatus on a continual basis.

Another object of this invention is to allow dimensional acoustic signals to be picked up by the apparatus in such a way as to not distort the tonal balance (such distortion is present in binaural prior art) nor lose the dimensional signal aspects (such loss is present in stereo microphone prior art).

Another object of this invention is to allow full compatibility with both headphone and loudspeaker playback/reproduction sound recreation with equal realism and tonal balance.

Another object of this invention is to provide mounting and attachment versatility as to be functional with standard apparel and style so as not to require user and viewers' adaptation or consideration as in the prior art.

Another object of this invention is to provide mounting of the pickups which is free to point the pickups in any direction the recordist desires within the dimensional recording area.

Another object of this invention is to provide output signals that couple to and are compatible with the majority of personal recorders with stereo microphone input jacks.

Another object of this invention is to provide for isolation of wind noise as experienced with outdoor environment recording.

Another object of this invention is to provide for acoustic response matching such that no further after-the-fact adjustments need to be performed by the user.

Another object of this invention is to provide mechanical vibrational noise from being recorded.

Another object of this invention is to provide simplified construction and thus ease of manufacture which, in turn, allows for lower cost to the amateur, casual user marketplace as compared to high quality prior art products that are relatively expensive.

The other objects, features and advantages of this invention will be apparent from the following description taken in conjunction with the accompanying drawings.

BRIEF DESCRIPTION OF THE DRAWINGS

The present invention with its various features and advantages will be described by way of example in conjunction with the accompanying drawings, in which.

DESCRIPTION OF THE PREFERRED EMBODIMENTS

Several embodiments of the stereo dimensional recording technique and microphone apparatus according to the present invention will be hereinafter described with reference to the drawings.

Figure 2:
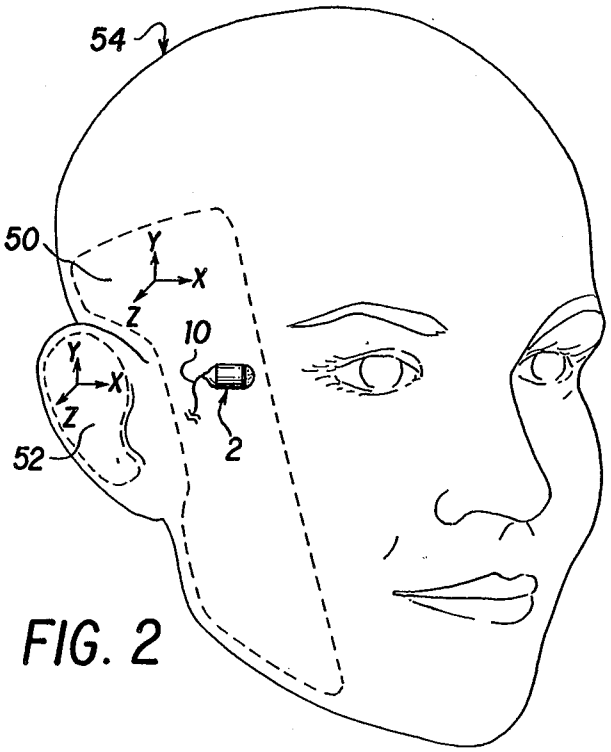
FIG. 2 is a perspective view of one side of a person's head/dummy head and the mounting area to be utilized by the present invention.
Figure 1:
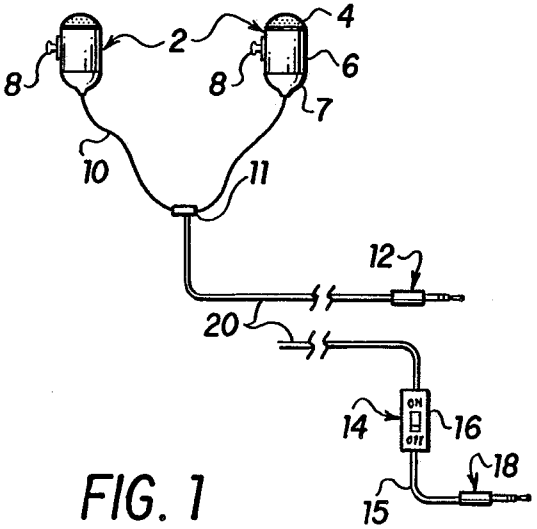
FIG. 1 is a representation of the stereo sound dimensional microphone apparatus of the present invention less apparel mounting accessories.

FIG. 1 shows an embodiment of the microphone, and FIG. 2 illustrates the difference in intended placement of the pickups compared to prior art techniques. In the figures, the reference letter M generally designates the microphone pickup cartridge 36 (FIGS. 9 and 10) and is optimally an electret design. The cartridge 36 is contained in a housing 6 usually made of plastic or metal, but is not limited to these in scope of materials possible. Attached to this housing 6 is a suitable acoustic windscreen 4 positioned at the input of the pickup 36. Also attached to housing 6 is the microphone output signal wire 10 and strain relief 7 which also serves to dampen wire wind noises that could interfere with intended outdoor uses. The output wire 10 is of shielded design, is of very small diameter and is highly flexible. The output wire 10 from both microphone assemblies 2 meet at a strain relief 11, and then continue molded together as a dual microphone signal output wire 20 to either a miniature stereo input plug 12 or a molded battery and circuit housing 14 depicted in FIG. 1 and FIG. 10. The case 14 minimally contains a battery 40 and switch 42, along with the associated resistors and capacitors R1-4 and C1-2 and are necessary only for tape recorders that lack such circuitry in their input lines.

The minimum circuit functions with R1-2 as M1-2's load and B+supply resistors. C1-2 serve only as direct current blocking capacitors feeding the output ground reference resistors R3-4. Furthermore, C1-2 should be of large enough capacitance to permit adequate low frequency audio signal output. R3-4 provide a ground referenced DC path for C1-2 output signals, as some recorders omit this function in their input lines, causing a floating DC potential condition. The battery 40 depicted in FIG. 10 powers the microphone pickups 36 when the on-off switch 42 is closed, allowing the aforementioned circuitry to function.

The minimum circuit, as stated, is necessary with most, not all, recorders and those recorders which lack the plug-in power feature. This said feature is commonly referred to as phantom power in the recording industry.

The case 14 can also contain an active gain stage 48 or preamplifier. This additional gain circuit 48 is necessary for most recorders that are currently under $100 retail cost regardless of a phantom power input feature. A design voltage gain of 20 decibels (×10) for this gain stage is an optimum gain value and is sufficient for all of the recorders this inventor has evaluated that require this additional circuitry 48. As required, the case 14 contains at least a battery 40 and switch 42 with the aforementioned minimum circuitry 44–47 and/or the optional preamplifier 48. The battery case 14 also features an external apparel mounting clip 16 for user convenience as desired. The output signal wire 15 is connected to either the output terminals of the minimum circuitry 44–47 or the amplifier 48, and connects to the stereo plug 18. The stereo plug 18 is then plugged into the microphone input jack of the recorder by the user.

The intended use and method of the invention is further illustrated in FIG. 2, which shows the intended primary microphone placement areas as related to the present invention's stereo dimensional recording method. Although only one side of a head 54 is shown, both sides are represented as mirror image logical views.

Whereas binaural recording and apparatus are concerned with the inside of the ear flap area 52, the stereo dimensional recording method and microphone apparatus, as intended by the present invention, is active in the areas forward and above the ear flap (or pinna) and protruding ear features, and extends into the temple and general cheek area 50. The invention, operating in area 50, has many advantages over previous methods and apparatus. The stereo dimensional recording method and microphone apparatus area 50 is virtually clear of causing interference with a person's normal hearing process, due to the invention's small size and position 50 as described. In a similar relationship of advantage over prior art, the microphone 2 is also free of interference that is prevalent with the ear flap sonic signature well known to binaural recordings and which rendered them (binaural) unacceptable under (exclusive of) loudspeaker playback.

Optimally, pickups 36 are of omnidirectional (non-directional) design and normally respond equally to sound from all directions. When these said pickups are placed in the present invention's stereo dimensional recording area 50, the head 54 shapes these normally non-directional pickups 36 in such a way as to give definite left and right directional field response that, coupled by the way we hear with our ears also gives us accurate dimensional information as well. The binaural recording method, on the other hand, placed the pickups in the ears, which vary greatly in shape from person to person, with every person having a different frequency and phase perception of sound. Those shape differences are what we individually compensate for when we hear sound. The present invention's recording method gives a more generic sound signal that is more easily recognized by all humans as realistic when reproduced by headphones and loudspeakers without any tonal prejudice as evident by prior art binaural recording method.

It should be clear that the invention directly addresses prior art drawbacks and limitations. The user will also be free of physical pain and discomfort in wearing the present invention for extended periods of time since the present invention can be light weight (each pickup less than 5 grams) and the present invention's method places the invention apparatus outside the ear area in the stereo dimensional recording area 50.

Figure 3:
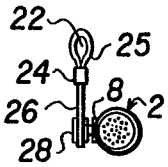
FIG. 3 shows a single pickup of the present invention together with the eyeglass mounting accessory.

In personal use, the microphone pickup assembly 2 in FIG. 1 is attached to various mounting accessories by detachable means such as snap fastener 8 or similar means. Such a means is viewed in FIG. 3 and FIG. 4 for eyeglass attachment. FIG. 3 shows the microphone assembly 2 connected to a mounting assembly 26 by means of the male snap type fastener 8 and into the female snap type fastener 28.

The body of the mounting 25 comprises material of flexible nature not limited to rubber or leather composition and will provide additional acoustical isolation from eyeglasses and wearer's natural movement.

Figure 4:
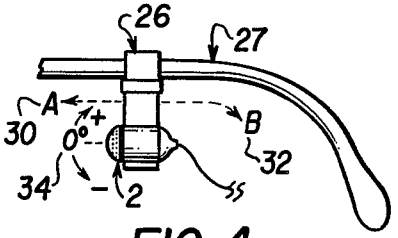
FIG. 4 is another view of the single pickup depicted in FIG. 3, mounted on the ear support leg of common eyewear.

The mounting grip tensioner 24 shown in FIG. 3 and FIG. 4 simply allows the adjustment of grip space 22, in turn facilitating ear support leg 27 insertion/adjustment along the x-axis in the direction of arrow 30 and removal in the direction of arrow 32 on various sizes of eyewear. As depicted in FIG. 4 the microphone pickup assembly 2 is free to rotate its vertical pointing direction as depicted by arrow 34 as the snap fastener parts 28 and 8 are circular in design. Although not specifically shown, the mounting assembly 26 is also free to be adjusted from the vertical hanging position shown in FIG. 4, through an arc in the yz plane, to horizontal or away from the person's cheek surface, and further, to full vertical, resulting in touching the temple surface above the eyeglass ear support leg 27.

This aforementioned positional versatility of the present invention apparatus is intended to encompass the user's need to adjust for most of the optimum stereo dimensional sound recording positions, and, also, to allow for a full variety of hair styles. Furthermore, the position of the microphone pickup assembly 2 in the invention's stereo dimensional recording xyz planes' area 50 will affect both sonic recording efficiency, as well as, sonic depth signals in relationship to both sound stage distance and sound stage width. The invention allows for these adjustments and deems them a necessary and novel feature of the invention.

Figure 6:
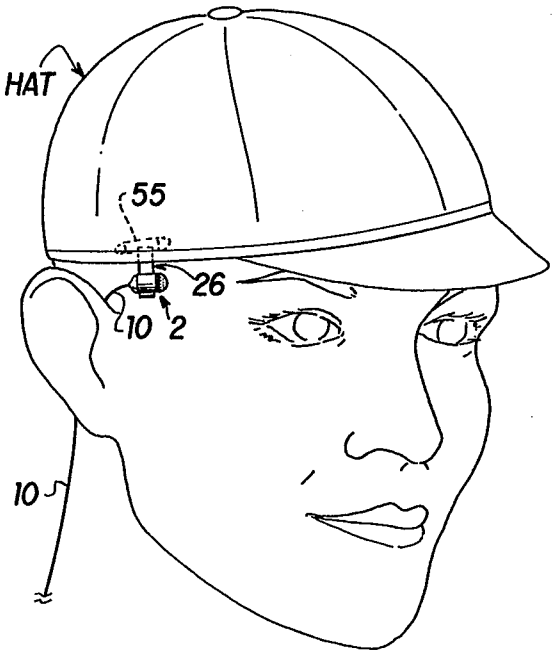
FIG. 6 illustrates the present invention's application to headwear apparel.
Figure 5:
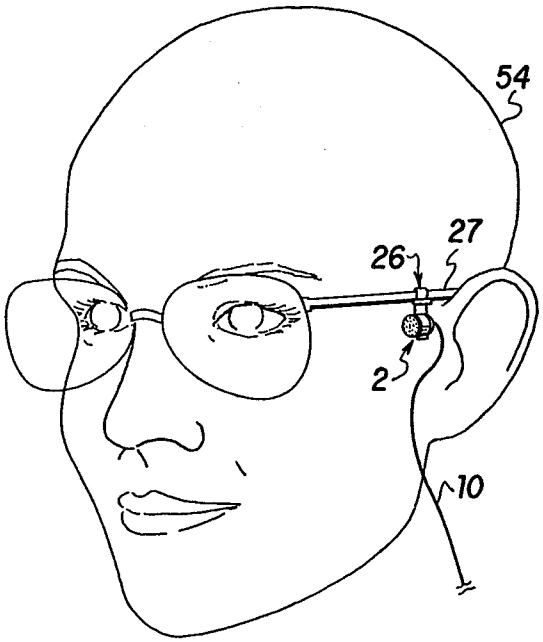
FIG. 5 further illustrates the present invention's application to eyewear apparel.
Figures 8, 9:
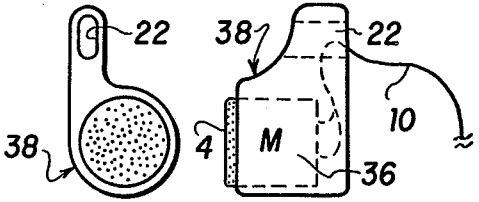
FIG. 8 is a front view of a variation of the microphone pickup of the present invention, integral with the eyeglasses and hat mounting system.
FIG. 9 is a side view of the variation shown in FIG. 8.

While FIG. 5 is a perspective view of eyeglass as the mounting platform of microphone 2, FIG. 6 shows in perspective a hot or headwear as the microphone mounting platform. FIGS. 3, 8, and 9 are attached to the material of the headwear apparel with a common safety pin 55 (see FIG. 6) or similar device. In this example, the pin 55 is inserted through the eyeglass ear support leg mounting space 22, as viewed in FIGS. 3, 8 and 9, through a short section of headwear material, and the pin 55. Although this mounting adaptation has most of the versatility of position adjustment as previously described in the eyeglasses mounting, the arc adjustment is not easily implemented to allow the pickup assembly 2 to be moved away from the cheek surface. Although not shown in the figures this limitation is easily solved, when deemed necessary, by the addition of a hinge mechanism or the like to the mounting body 25 at around its midpoint.

Figure 7:
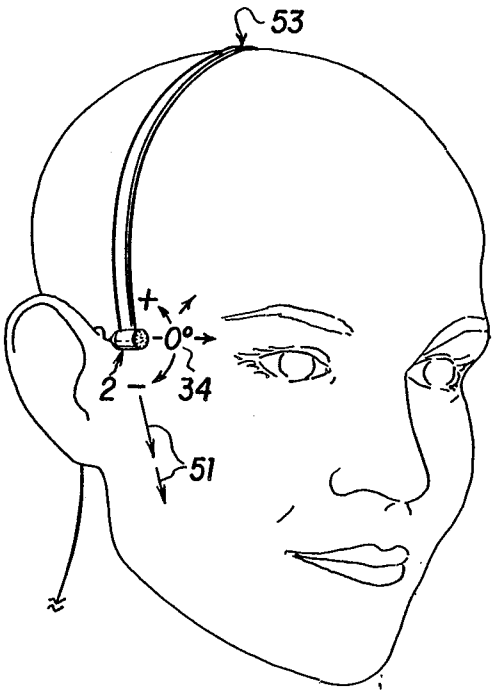
FIG. 7 illustrates the present invention's application with a headband accessory.

The addition of a headband accessory 53 as shown in FIG. 7 is another variation for mounting the microphone pickup assembly 2 without the need for eyeglasses or headwear apparel, and allows for adjustment as previously described in the direction of arrows 30, 32, and 34 within the invention's stereo dimensional recording area 50. This said variation does increase the visibility of the invention and is intended for use where visibility of the apparatus is of less importance to the wearer of the invention apparatus (as in dummy head mounting professional uses) than versatility of assembly 2 positioning. The headband 53 is also wearable and partially supportable by the ear flap in the horizontal position (across the back of the head 54), and is an anticipated mounting variation in placing the microphone pickup assembly 2 in the invention's stereo dimensional recording area 50.

In addition to the aforementioned versatility of the headband 53, but not shown in FIG. 7, is the headband's 53 ability to telescope 51 at the temple area, to allow the pickup assembly 2 to move downward (y-axis) or outward (z-axis) 51 through the invention's stereo dimensional recording area 50. In addition to the aforementioned directions 51 and 53, increased adjustment is facilitated by swivel movement in the direction of arrow 34, and the aforementioned arc movement (yz plane away from the head surface) adjustment features that are intentionally included with the design example.

Although not shown, a telescoping eyeglasses' mounting is also an allowable possible variation of the invention apparatus, to further pickup assembly 2 movement and adjustment to suit the recordist's technique, and is implemented with a small portable radio-type FM telescoping antenna or similar working mechanism along arrow 51. Also not specifically shown in any of the pickup 2 mountings, are other mounting variations which allow pickup 2 to point in any direction desired within the stereo dimensional recording area 50. These said mounting adjustments are deemed a necessary and novel feature of the invention.

The simplest embodiment of the present invention, shown in FIGS. 8 and 9, includes the microphone pickup assembly and apparel mounting as a one-piece unit 38. A mirror image matched assembly 38 is connected, as previously described in FIG. 1, with an output signal wire 10 from each of the two pickups, joining at some strain relief point 11, and continuing with the output wire 20 to an output plug 12. This simplest embodiment, while the least cost to both manufacturer and consumer, requires the tape recorder used to feature suitable power and decoupling circuitry, after the microphone input jack.

Furthermore, the recorder must have suitable preamplifier gain. These necessary recorder features are presently only common in medium to high-priced recorders.

Figure 10:
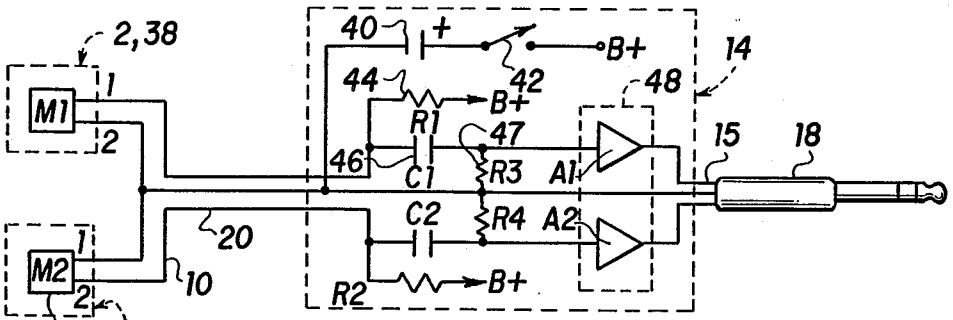
FIG. 10 is the electrical schematic of the microphone with the battery and associated circuitry and optional amplifier gain stage of the present invention.

Therefore, in keeping with the present invention's intended use with most all recording machines, FIG. 1 shows the necessary hardware for this purpose, as previously stated. FIG. 10 is a schematic representation of this more usable version of the invention, and employes circuitry well known to those versed in these arts. The designated M1,2 36 in FIG. 10 are factory matched electret type cartridge elements common to most all tape recorders, answering machines, voice-operated toys, etc., and require no further specification other than the inventor's intention that they be of the best available quality for music recording purposes.

The personally-wearable stereo dimensional recording method and microphone apparatus has been tested in numerous indoor and outdoor environments with gratifying results using a variety of portable tape recorders of varying cost and sophistication. The recordings have equal playback performance with headphones and loudspeakers alike, with professional quality, especially with the better designed tape cassette type recorders available to all consumers. The recordings demonstrate an immediate spacious sound with individual directional sources clearly in place as in the live experience, independent of sound stage distance.

The use of the recordist's head or dummy head 54 as desired, and not the ears 52, to shape the invention's sonic input gives the resultant recording the natural live tonal balance and sound depth and position necessary for realistic listening via both headphones and loudspeakers. When personally worn, the invention's small size and mounting techniques presented have allowed the tester of this invention to record without interference or interfering. The eyeglasses and headwear mountings illustrated have been successful in allowing full comfort to the user and a candid environment for those around. The tests done with the glasses' mounting show that the present invention apparatus looks very similar to conventional glasses' holding clips that are very popular with eyeglasses and sunglasses wearers of all ages. Furthermore, this configuration of the invention apparatus functions as glasses holding clips, in that the glasses, when removed from the wearer's head, will naturally hang by the microphone wires with the stress relief 11 in FIG. 1, keeping the spectacles from further travel, and providing a natural useful function when not in place on the head during recording.

It will be apparent that the above mentioned stereo dimensional recording method and microphone apparatus is not limited to the aforesaid embodiments, but a number of changes and variations can be effected without departing from the scope of this invention.

What is claimed is:

1. A method of stereophonic dimensional recording of sound waves, the method comprising the steps of:

(a) mounting each one of a pair of stereophonic microphones externally on a corresponding side of a human head or a simulated human head adjacent a region defined substantially by an imaginary line drawn along the lower extremity of the jaw bone, then extending upward through the cheek area, behind the eye, then backward to include the temporal region and above the ear, then downward forward of the ear to the jaw bone, away from the ear pinnas and protruding ear features of the human head or artificial ear pinnas and without covering or blocking the ear pinna or ear canal with a portion of the head interposed between each of said microphones;

(b) detecting said sound waves with said pair of microphones mounted as in step a.; and (c) directing the detected sound waves of step b. to a stereophonic recording device.

2. A stereophonic dimensional recording microphone assembly comprising:

a pair of stereophonic microphones connected to a stereophonic recording device; and mounting means for mounting each one of said pair of stereophonic microphones externally on a corresponding side of a human head or a simulated human head adjacent a region defined substantially by an imaginary line drawn along the lower extremity of the jaw bone, then extending upward through the check area, behind the eye, then backward to include the temporal region and above the ear, then downward forward of the ear to the jaw bone, away from the ear pinnas and protruding ear features of the human head or artificial ear pinnas and without covering or blocking the ear pinna or ear canal, with a portion of the head interposed between each of said microphones.

3. A method as in claim 1 wherein step a is performed using means for suspending said stereophonic microphones from the legs of a pair of eyeglasses on the human or dummy head.

4. A method as in claim 1 wherein step a is performed using means for suspending said stereophonic microphones from the edge of a cap on the human or dummy head.

5. A method as in claim 1 wherein step a is performed using means for suspending said stereophonic microphones from the ends of a head band means.

6. A method as in claim 1 further includes the step of:

(c) acoustically conditioning the sound waves before performing step b.

7. An assembly as in claim 2 further including means surrounding a sound wave input region of each of said microphones for acoustically conditioning the sound waves before being detected by the microphone.

8. An assembly as in claim 2 wherein each of said microphones is omnidirectional.

9. An assembly as in claim 2 wherein said mounting means includes means for suspending one of said pair of microphones from each of the legs of a pair of eyeglasses on the human or dummy head.

10. An assembly as in claim 2 wherein said mounting means includes means for suspending one of said pair of microphones from each side of a cap or hat on the human or dummy head.

11. An assembly as in claim 2 wherein said mounting means includes a head band that passes over the human or dummy head disposed to suspend one of said pair of microphones from either end thereof.

* * * * *